US011228832B2

(12) United States Patent
Sim et al.

(10) Patent No.: US 11,228,832 B2
(45) Date of Patent: Jan. 18, 2022

(54) ELECTRONIC DEVICE INCLUDING ACOUSTIC DUCT HAVING A VIBRATABLE SHEET

(71) Applicant: SAMSUNG ELECTRONICS CO., LTD., Suwon-si (KR)

(72) Inventors: Myoungsung Sim, Suwon-si (KR); Youngbae Park, Suwon-si (KR); Choonghyo Park, Suwon-si (KR); Byounghee Lee, Suwon-si (KR); Seungnam Kim, Suwon-si (KR); Juhwan Woo, Suwon-si (KR); Hochul Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/841,784

(22) Filed: Apr. 7, 2020

(65) Prior Publication Data

US 2020/0329303 A1 Oct. 15, 2020

(30) Foreign Application Priority Data

Apr. 9, 2019 (KR) ..... 10-2019-0041517

(51) Int. Cl.
*H04R 1/28* (2006.01)
*H04R 1/02* (2006.01)

(52) U.S. Cl.
CPC ..... *H04R 1/2811* (2013.01); *H04R 1/028* (2013.01); *H04R 2499/11* (2013.01); *H04R 2499/15* (2013.01)

(58) Field of Classification Search
CPC .. H04R 1/2811; H04R 1/028; H04R 2499/11; H04R 2499/15
(Continued)

(56) References Cited

U.S. PATENT DOCUMENTS 5,150,417 A 9/1992 Stahl
7,916,878 B2 3/2011 Bank et al.
(Continued)

FOREIGN PATENT DOCUMENTS

KR 1999-0073516 10/1999
KR 10-1622678 5/2016
(Continued)

OTHER PUBLICATIONS

International Search Report and Written Opinion dated Jul. 28, 2020 in counterpart International Application No. PCT/PCT/KR2020/004677.

*Primary Examiner* — Norman Yu
(74) *Attorney, Agent, or Firm* — Nixon & Vanderhye P.C.

(57) ABSTRACT

An electronic device is disclosed. According to an embodiment of the disclosure, the electronic device comprises a housing including a plate defining a first face of the electronic device and a side portion extending along an edge of the plate and defining a side face of the electronic device, a speaker including a sound outlet disposed in a support portion of the housing extending from the side member to an inner space of the electronic device, the sound outlet disposed in a direction facing the first face, a sheet disposed between the plate and the speaker, and an acoustic duct defined in part by the sheet and the support portion, spaced apart from the plate, and extending from the sound outlet of the speaker to the side face.

18 Claims, 15 Drawing Sheets

(58) Field of Classification Search
USPC ..... 381/333–336, 337–339, 345, 162, 365
See application file for complete search history.

(56) References Cited

U.S. PATENT DOCUMENTS

| | | | | |
|---|---|---|---|---|
| 8,724,841 | B2 * | 5/2014 | Bright | H04R 1/086 381/359 |
| 9,143,847 | B2 | 9/2015 | Dodd | |
| 10,129,378 | B2 * | 11/2018 | Nonaka | H04M 1/035 |
| 2009/0291718 | A1 | 11/2009 | Fukazawa | |
| 2011/0026757 | A1 * | 2/2011 | Takahashi | H04R 7/26 381/397 |
| 2013/0156245 | A1 | 6/2013 | Dix et al. | |
| 2016/0037243 | A1 * | 2/2016 | Lippert | H04R 1/086 381/166 |
| 2016/0127835 | A1 | 5/2016 | Jiang et al. | |
| 2017/0055069 | A1 * | 2/2017 | Lee | H04R 1/2838 |
| 2018/0132020 | A1 * | 5/2018 | Seo | H04M 1/03 |

FOREIGN PATENT DOCUMENTS

| | | |
|---|---|---|
| KR | 10-2016-0142385 | 12/2016 |
| KR | 10-1880465 | 7/2018 |
| KR | 101919454 | 11/2018 |

* cited by examiner

ELECTRONIC DEVICE INCLUDING ACOUSTIC DUCT HAVING A VIBRATABLE SHEET

CROSS REFERENCE TO RELATED APPLICATION

This application is based on and claims priority under 35 U.S.C. § 119 to Korean Patent Application No. 10-2019-0041517, filed on Apr. 9, 2019, in the Korean Intellectual Property Office, the disclosure of which is incorporated by reference herein in its entirety.

BACKGROUND

Field

The disclosure relates to an electronic device including an acoustic duct having a vibratable sheet.

Description of Related Art

An electronic device may include a display device for outputting a screen and a speaker device for outputting a sound. A space for mounting the speaker device inside the electronic device may be narrow when the electronic device is small in size. A sound outlet of the speaker placed inside the electronic device may face a rear plate or a face of by the display device. A high-frequency acoustic band emitted from the speaker has a strong linearity, which may lead to a degradation of a characteristic of a sound traveling to a front or rear plate of the display. In order to mitigate the degradation of the acoustic characteristic, the electronic device may use an instrument inside a housing to transfer a sound, emitted from the speaker, to a side face of the housing.

An electronic device such as a mobile device is gradually decreased in size. Since the electronic device is widely used in various places such as swimming pools, beaches, or the like, an additional instrument for waterproofing and dustproofing may be provided inside the electronic device. When a speaker placed inside the electronic device is implemented with lateral emission, an acoustic duct may be constructed of an instrument of a housing. The acoustic duct includes a narrow portion in a region adjacent to the speaker. When a sound emitted from the speaker passes through the narrow portion, an acoustic tremor may occur due to an increase in an acoustic impedance of the narrow portion, and an acoustic characteristic of the electronic device may be degraded.

SUMMARY

Embodiments of the disclosure provide an electronic device having an acoustic duct capable of avoiding a deterioration of an acoustic characteristic while maintaining a lateral emission structure of a sound.

An electronic device according to an example embodiment may include a housing including a plate defining a first face of the electronic device and a side portion extending along an edge of the plate to provide a side face of the electronic device, a speaker including a sound outlet disposed on a support extending from the side portion to an inner space and configured to emit a sound in a direction facing the first face, a sheet disposed between the plate and the speaker, and an acoustic duct defined at least in part by the sheet and the support portion, the acoustic duct being spaced apart from the plate and extending from the sound outlet of the speaker to a part of the side face.

An electronic device according to an example embodiment may include a plate defining a first face of the electronic device, a display defining a second face of the electronic device, the second face facing the first face and including a plurality of layers, a side portion of a housing extending along an edge of the plate to provide a side face of the electronic device, a speaker including a sound outlet disposed on a support portion extending from the side portion to an inner space and configured to emit a sound in a direction facing the first face, a sheet disposed between the plate and the speaker, a first space provided along the sheet and the support portion and being spaced apart from the plate, the first space configured to pass a sound emitted from the sound outlet, a second space provided by the support portion and coupled to the first space, the second space extending in a direction away from the plate, and a third space provided by the support portion and coupled to the second space extending in a direction facing the side face.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
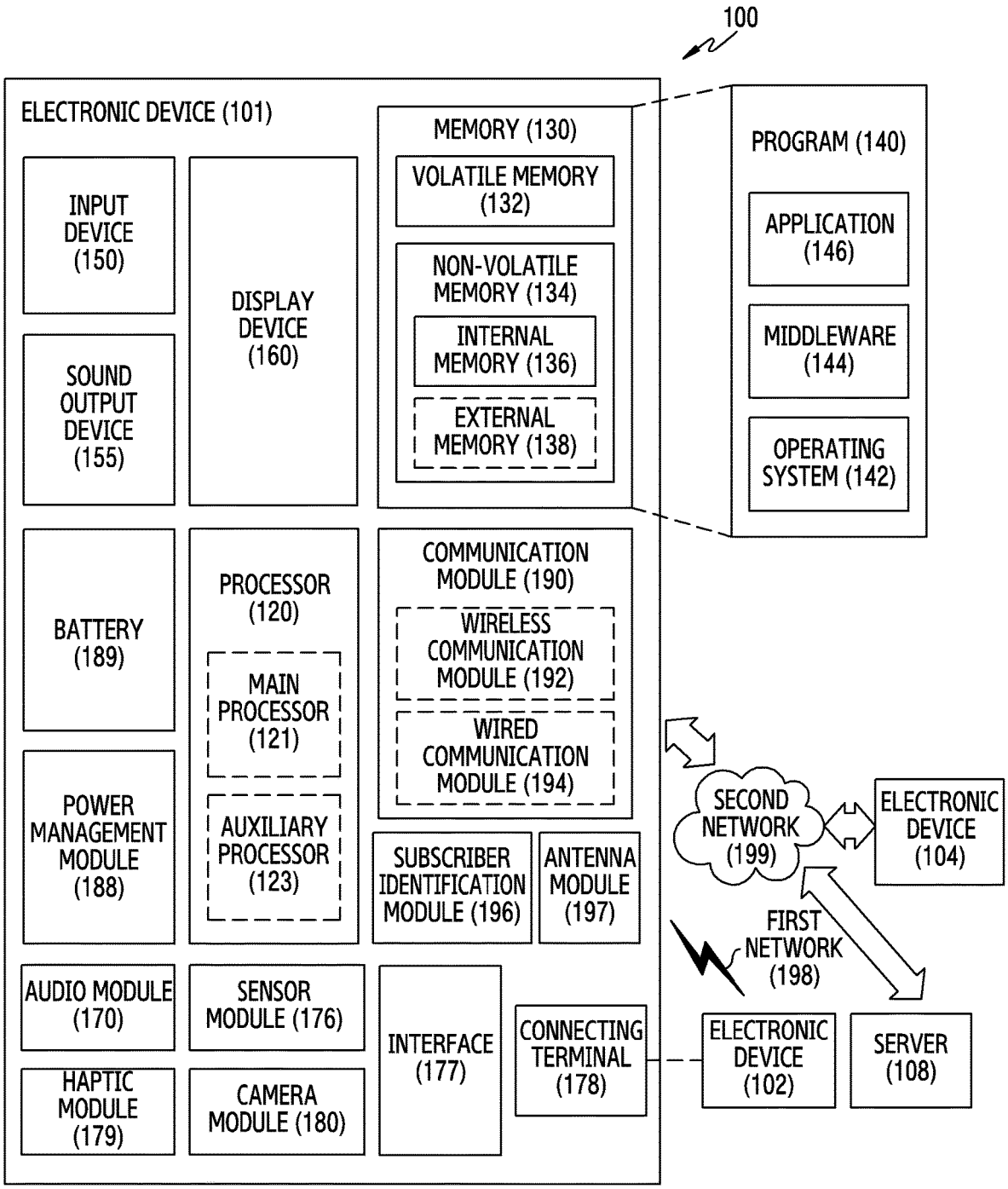
FIG. 1 is a block diagram illustrating an example electronic device in a network environment according to an embodiment.

FIG. 1 is a block diagram illustrating an electronic device 101 in a network environment 100 according to an embodiment. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to an example embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an example embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, a home appliance, or the like. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in any other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), the element may be coupled with the other element directly (e.g., wiredly), wirelessly, or via a third element.

As used herein, the term "module" may include a unit implemented in hardware, software, or firmware, or any combination thereof, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the "non-transitory" storage medium is a tangible device, and may not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
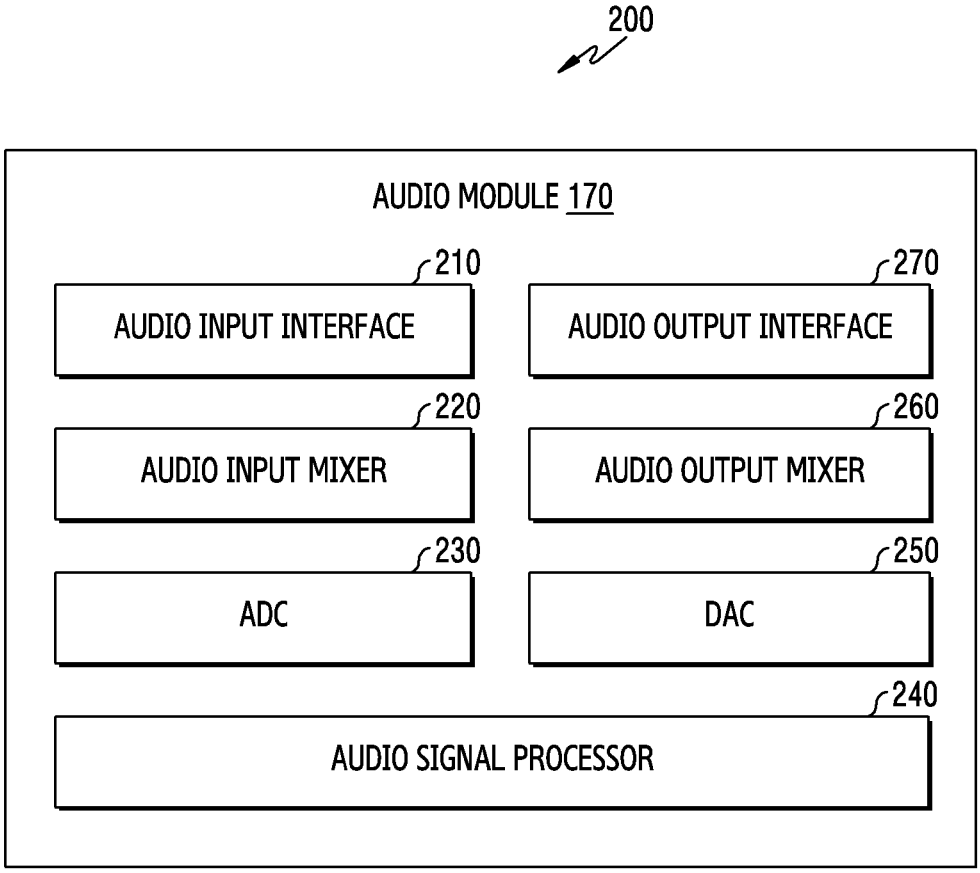
FIG. 2 is a block diagram illustrating an example audio module according to an embodiment.

FIG. 2 is a block diagram 200 illustrating an example audio module 170 according to an embodiment. Referring to FIG. 2, the audio module 170 may include, for example, an audio input interface (e.g., including audio input circuitry) 210, an audio input mixer (e.g., including audio mixing circuitry) 220, an analog-to-digital converter (ADC) 230, an audio signal processor (e.g., including audio signal processing circuitry) 240, a digital-to-analog converter (DAC) 250, an audio output mixer (e.g., including audio mixing circuitry) 260, and/or an audio output interface (e.g., including audio output circuitry) 270.

The audio input interface 210 may include various audio input circuitry and receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. According to an embodiment, additionally or alternatively, the audio input interface 210 may receive an audio signal from another component (e.g., the processor 120 or the memory 130) of the electronic device 101.

The audio input mixer 220 may include various audio mixing circuitry and synthesize a plurality of input audio signals into at least one audio signal. For example, according to an embodiment, the audio input mixer 220 may synthesize a plurality of analog audio signals input via the audio input interface 210 into at least one analog audio signal.

The ADC 230 may include various analog to digital converting circuitry and convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may include various audio signal processing circuitry and perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 240 may be implemented in the form of an equalizer.

The DAC 250 may include various digital to analog converting circuitry and convert a digital audio signal into an analog audio signal. For example, according to an embodiment, the DAC 250 may convert a digital audio signal processed by the audio signal processor 240 or a digital audio signal obtained from another component (e.g., the processor (120) or the memory (130)) of the electronic device 101 into an analog audio signal.

The audio output mixer 260 may include various audio mixing circuitry and synthesize a plurality of audio signals, which are to be output, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may include various audio output circuitry and output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. According to an embodiment, the audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (not shown) (e.g., a speaker amplifying circuit) that is capable of amplifying an analog audio signal input via the audio input interface 210 or an audio signal that is to be output via the audio output interface 270. According to an embodiment, the audio amplifier may be configured as a module separate from the audio module 170.

Figure 3A:
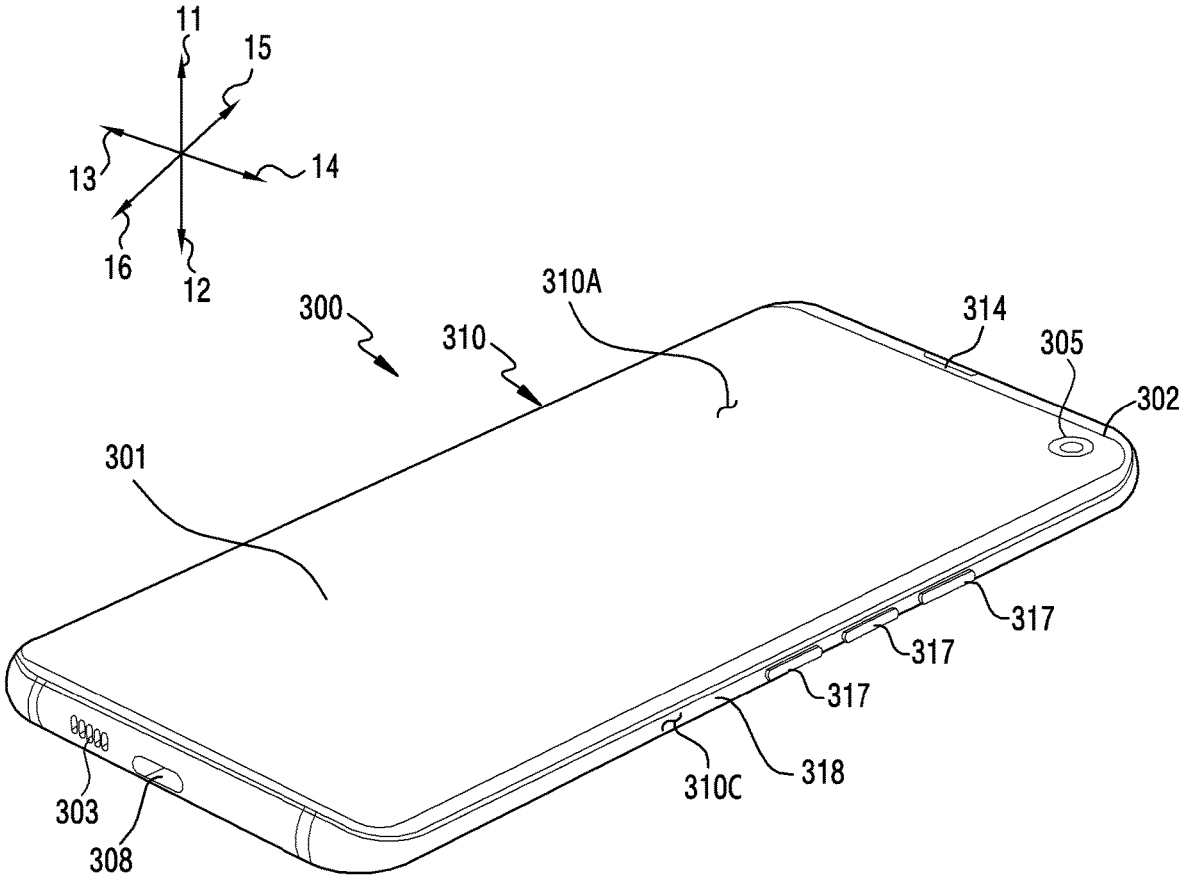
FIG. 3A is a front perspective view illustrating an example electronic device according to an embodiment.
Figure 3B:
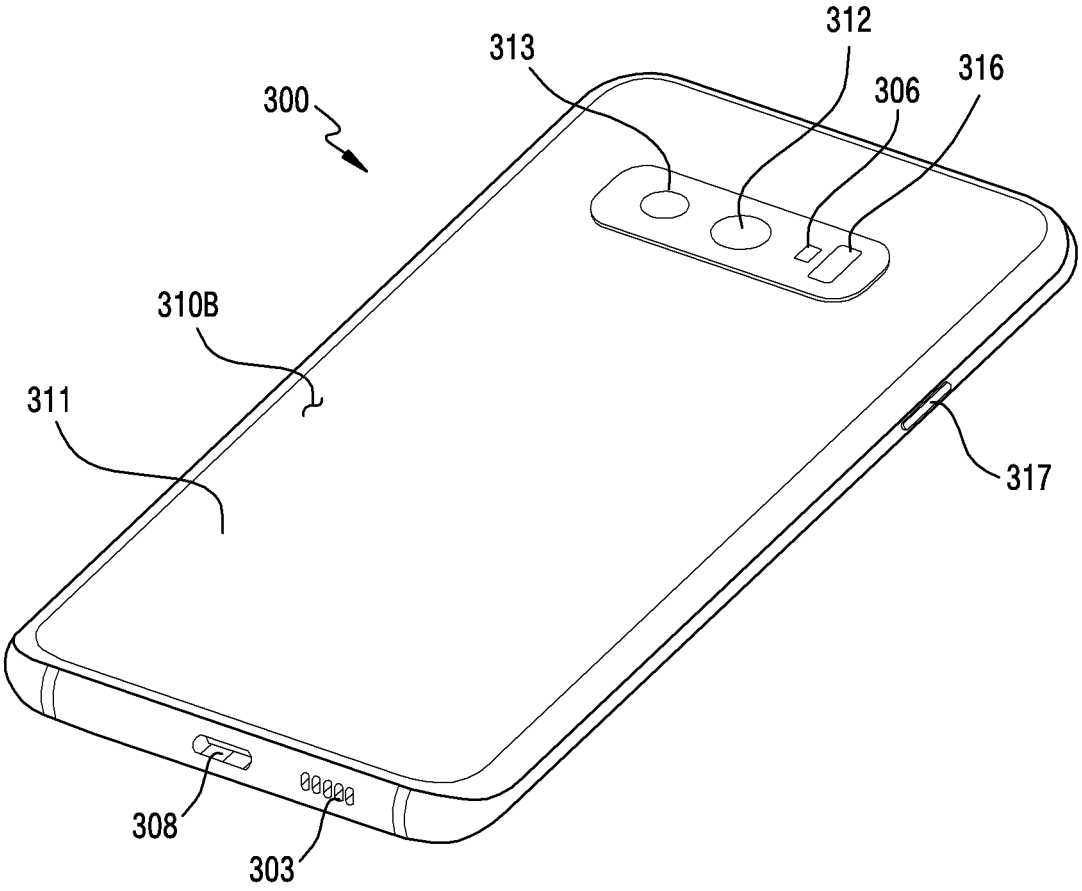
FIG. 3B is a rear perspective view of the electronic device 300 of FIG. 3A.

FIG. 3A is a front perspective view illustrating an example electronic device 300 (e.g., the electronic device 101 of FIG. 1) according to an embodiment of the disclosure. FIG. 3B is a rear perspective view of the electronic device 300 of FIG. 3A.

Referring to FIG. 3A and FIG. 3B, the electronic device 300 according to an embodiment may include a housing 310 including a first face (or a front face) 310A, a second face (or a rear face) 310B, and a side face (or a side wall) 310C surrounding a space between the first face 310A and the second face 310B. In another embodiment (not shown), the housing may refer, for example, to a structure constructing (e.g., forming) some of the first face 310A, second face 310B, and side face 310C of FIG. 3A and FIG. 3B.

According to an embodiment, the first face 310A may include a front plate 302 (e.g., a glass plate including various coating layers, or a polymer plate) of which at least part is substantially transparent. According to an embodiment, the front plate 302 may include a curved portion in at least a side edge portion. The curved portion is seamlessly extended by being bent from the first face 310A toward the rear plate 311.

According to an embodiment, the second side 310B may include a rear plate 311 which is substantially opaque. The rear plate 311 may be constructed by, for example, coated or colored glass, ceramic, polymer, metal (e.g., aluminum, stainless steel (STS), or magnesium), or a combination of at least two of the these materials. According to an embodiment, the rear plate 311 may include a curved portion in at least a side edge portion. The curved portion is seamlessly extended by being bent from the second face 310B toward the front plate 302.

According to an embodiment, the side face 310C may be combined with the front plate 302 and the rear plate 311 and may include a side bezel structure (or a side member or a side wall) 318 including metal and/or polymer. In some embodiments, the rear plate 311 and the side bezel structure 318 may be integrally formed, and may include the same material (e.g., a metal material such as aluminum).

According to an embodiment, the electronic device 300 may include at least one of a display 301, audio modules 303 and 314, a sensor module, a camera module 305, a key input device 317, and a connector hole 308. In some embodiments, at least one (e.g., the key input device 317) of the components may be omitted, or the electronic device 300 may additionally include other components. For example, the electronic device 300 may include a sensor module (not shown). For example, in a region provided by the front plate 302, a sensor such as a proximity sensor or an illumination sensor may be integrated in the display 301, or may be disposed at a position adjacent to the display 301. In some embodiments, the electronic device 300 may further include a light emitting element. The light emitting element may be disposed at a position adjacent to the display 301, in the region provided by the front plate 302. The light emitting element may provide, for example, state information of the electronic device 300 in an optical form. In another embodiment, the light emitting element may provide, for example, a light source interworking with an operation of the camera module 305. The light emitting element may include, for example, a Light Emitting Diode (LED), an InfraRed (IR) LED, and a xenon lamp.

The display 301 may be viewable through, for example, some portions of the front plate 302. In some embodiments, a corner of the display 301 may be substantially the same as an outer boundary (e.g., a curved face) adjacent to the front plate 302. In another embodiment (not shown), in order to expand an area in which the display 301 is viewable, the display 301 and the front plate 302 may have substantially the same interval between outer boundaries thereof. In another embodiment (not shown), the display 301 may have a recess or opening at a part of a screen display region, and may include other electronic components (e.g., the camera module 305, a proximity sensor (not shown), or an illumination sensor (not shown)) which are aligned with the recess or the opening.

In another embodiment (not shown), at least one of camera module 312 and 313, a fingerprint sensor 316, and a flash 306 may be included in a rear face of the screen display region of the display 301. In another embodiment (not shown), the display 301 may be combined with or adjacent to a touch sensing circuit, a pressure sensor capable of measuring touch strength (pressure), and/or a digitizer for detecting a magnetic-type stylus pen.

The audio modules 303 and 314 may include a microphone hole and a speaker hole. The microphone hole may have a microphone disposed inside thereof to acquire an external sound, and in some embodiments, may have a plurality of microphones disposed to sense a sound direction. In some embodiments, the speaker hole and the microphone hole may be implemented as the single hole 303, or a speaker (e.g., a Piezo speaker) may be provided without the speaker hole. The speaker hole may include an external speaker hole and the call receiver hole 314.

The electronic device 300 includes a sensor module (not shown), and thus may generate an electrical signal or data value corresponding to an internal operating state or an external environmental state. The sensor module may include, for example, a proximity sensor disposed to the first face 310A, a fingerprint sensor integrated or disposed adjacent to the display 310, and/or a biometric sensor (e.g., a Heart Rate Monitoring (HRM) sensor) disposed to the second face 310B of the housing 310. The electronic device 300 may further include at least one of sensor modules (not shown), for example, a gesture sensor, a gyro sensor, an atmospheric pressure sensor, a magnetic sensor, an acceleration sensor, a grip sensor, a color sensor, an IR sensor, a biometric sensor, a temperature sensor, a humidity sensor, and an illuminance sensor.

The camera modules 305, 312, 313 may include the first camera device 305 disposed to the first face 310A of the electronic device 300, and the second camera devices 312 and 313 and/or flash 306 disposed to the second face 310B. The camera devices 305, 312, and 313 may include one or more lenses, an image sensor, and/or an image signal processor. The flash 306 may include, for example, an LED or a xenon lamp. In some embodiments, two or more lenses (infrared cameras, wide angle and telephoto lenses) and image sensors may be disposed to one face of the electronic device 300.

The key input device 317 may be disposed to the side face 310C of the housing 310. In another embodiment, the electronic device 300 may not include some or all of the aforementioned key input devices 317, and the key input device 317 which is not included may be implemented in any other form such as a soft key or the like on the display 301. In some embodiments, the key input device may include at least part of the fingerprint sensor 316 disposed to the second face 310B of the housing 310.

The connector hole 308 may accommodate a connector for transmitting and receiving power and/or data with respect to an external electronic device and/or a connector for transmitting and receiving an audio signal with respect to the external electronic device. For example, the connector hole 308 may include a Universal Serial Bus (USB) connector or an earphone jack.

Figure 4:
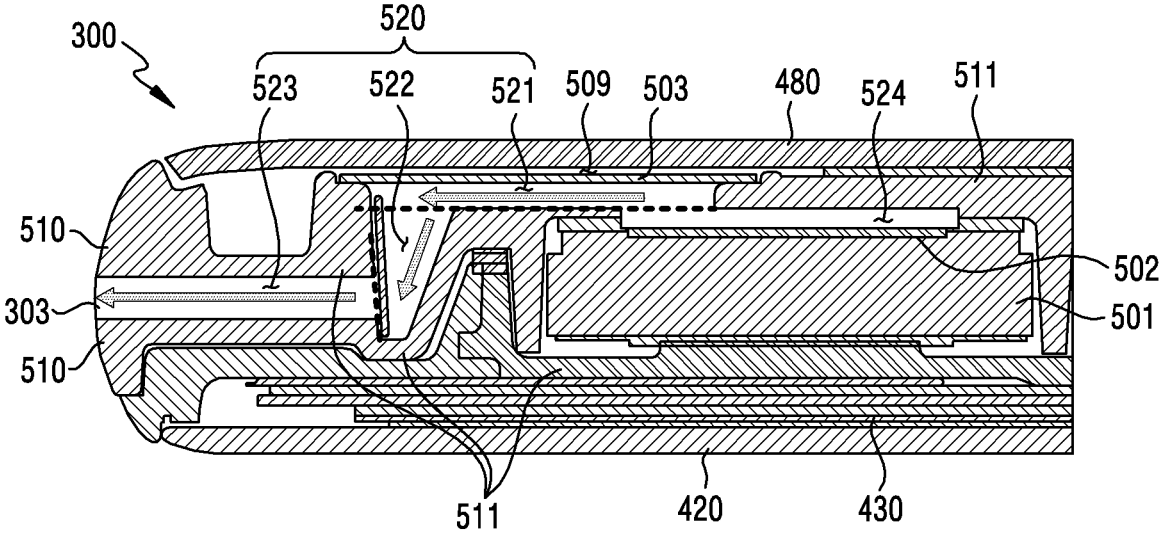
FIG. 4 is a cross-sectional view of an example electronic device according to an embodiment.

FIG. 4 is a cross-sectional view illustrating an example electronic device 300 according to an embodiment.

Referring to FIG. 4, the electronic device 300 may include a front plate 420, a display 430, a side member 510, a rear plate 480, a speaker 501, and an acoustic duct 520.

According to an embodiment, the face plate 420 may construct (e.g., provide or form. The term "construct" as used herein may be used interchangeably with the terms "provide", "form" or "define") a first face (e.g., the first face 310A of FIG. 3A) of the electronic device 300. The rear plate 480 may be disposed to face the front plate 420, and may construct a second face (e.g., the rear face 310B of FIG. 3B) of the electronic device 300. The side member (e.g., side portion) 510 may be constructed to surround an inner space between the front plate 420 and the rear plate 480, and may extend along an edge of the front plate 420 and rear plate 480. The side member 510 may construct at least part of a third face (e.g., the side face 310C of FIG. 3A) between the first face and the second face. The front plate 420 may be constructed of a transparent material. For example, the front plate 420 may include a transparent polymer (e.g., PolyImide (PI), PolyEthylene Terephthalate (PET)) and/or glass.

According to an embodiment, a support member 511 may extend to an inner space from the side member 510. The support portion 511 may support an electronic component (e.g., a speaker, a camera, or a printed circuit board) disposed inside the electronic device 300. In an embodiment, the support portion 511 may have an independent structure distinct from the side member 510. In another embodiment, the support member 511 may be integrally formed with the side member 510. In an embodiment, the support portion 511 may be plural in number.

According to an embodiment, the display 430 may be disposed between the face plate 420 and the support portion 511. The display 430 may include a plurality of layers. For example, the display 430 may include at least one of a Thin Film Transistor (TFT) layer, an electrode layer, an organic layer, and/or a pixel layer. The display 430 may emit light from a pixel to transfer information to a user, and the emitted light may be transferred to the outside through the front plate 420.

According to an embodiment, the speaker 501 may be disposed in the inner space formed by the front plate 420 and the rear plate 480. The speaker 501 may be supported by the support portion 511 extending from the side member 510, and may be disposed to emit a sound in a direction of the rear plate 480. The speaker 501 may be fixedly disposed inside the support portion 511.

According to an embodiment, the speaker 501 may include a sound outlet 502 provided at a main body of the speaker 501. The sound output 502 of the speaker 501 may be disposed to face the rear plate 480. The speaker 501 may be disposed in a direction in which the sound outlet 502 faces the rear plate 480. According to an embodiment, when the speaker 501 emits a sound in a direction of the rear plate 480, the electronic device 300 may provide an acoustic characteristic superior to that of a case where the sound is emitted toward the display 430 stacked of a plurality of layers. Since the rear plate 480 does not include a multilayer structure unlike in the display 430 including a plurality of layered faces, vibration of the sound transferred from the speaker 501 may be easily transferred. According to an embodiment, when the speaker 501 is disposed such that the sound outlet 502 faces the rear plate 480, the electronic device 300 may secure a space for disposing several members (e.g., a sheet 503 of the support portion 511) forming the acoustic duct 520. According to an embodiment, the speaker 501 may include a protection member (not shown) disposed at a face where the sound outlet 502 is located to surround the sound outlet 502. A fourth space 524 may be defined by the support portion 511 and a face where the sound outlet 502 of the speaker 501 is disposed. The speaker 501 may transfer the sound emitted through the sound outlet 502 to the acoustic duct 520.

According to an embodiment, the speaker 501 may include a front face where the sound outlet 502 is provided and a rear face facing the front face. A part of the rear face of the speaker 501 may be in contact with the support portion 511, and the remaining parts of the speaker 501 may be spaced apart from the support portion 511 to define a rear space. According to an embodiment, in order to prevent and/or reduce leakage of a sound transferred to the rear face, a rear space defined by the rear face of the speaker 501 and the support portion 511 may be sealed.

The speaker 501 may include a magnetic circuit including a yoke and a magnet in a frame, a voice coil located at an air gap of the magnetic circuit, a side vibration plate and center vibration plate vibrating by the voice coil, a suspension for guiding movement of the voice coil and vibration plate, a terminal pad for receiving an electrical signal from the outside to transfer the electrical signal to the voice coil through the suspension, or the like. The speaker 501 may include a micro-speaker.

According to an embodiment, the acoustic duct 520 may extend to a side face of the electronic device 300, provided by the side member 510, from a space adjacent to the sound outlet 502 of the speaker 501. The acoustic duct 520 may be coupled with the speaker hole 303 provided at a side face (e.g., the side face 310C of FIG. 3A) of the electronic device 300. The acoustic duct 520 may be defined by the sheet 503 and the side member 510 including the support portion 511. The acoustic duct 520 may transfer a sound emitted from the speaker 501 to the outside.

According to an embodiment, the acoustic duct 520 may include a first space 521, a second space 522, and a third space 523. According to an embodiment, the sound emitted from the speaker 501 may sequentially pass through the first space 521, the second space 522, and the third space 523 and thus may be transferred to the outside of the electronic device 300.

According to an embodiment, the fourth space 524 may be defined by a face of the speaker 501, to which the sound outlet 502 is disposed, and a part of the support portion 511. The fourth space 524 may be coupled with the acoustic duct 520. The fourth space 524 may be provided between the speaker 501 and the rear plate 480. A sound emitted from the sound outlet 502 may pass through the fourth space 524.

According to an embodiment, the first space 521 may be defined by the sheet 503 and the support portion 511. The first space 521 may extend along the rear plate 480 in a direction away from the speaker 501. The first space 521 may be coupled with the fourth space 524, and a sound passed through the fourth space 524 may pass through the first space 521. The first space 521 may include a relatively narrow space in which a cross-sectional area of the acoustic duct 520 is small. The sheet 503 vibrating by the sound emitted from the speaker 501 may reduce an acoustic impedance which increases in a narrow space.

According to an embodiment, the second space 522 may be defined by the support portion 511. The second space 522 may extend in a direction away from the rear plate 480 (or a direction facing the front plate 420). The second space 522 may be coupled with the first space 521, and a sound passed through the first space 521 may be passed through the second space 522. The second space 522 may extend from an edge of the first space 521 in a direction of the front plate 420.

According to an embodiment, the third space 523 may be defined by the support portion 511 and/or the side member 510. The third space 523 may extend in a direction facing the side member 510 by passing through the support portion 511. The third space 523 may be coupled with the second space 522, and a sound passed through the second space 522 may pass through the third space 523. To prevent and/or reduce a foreign material from entering into the electronic device 300, a mesh member (not shown) may be disposed at a boundary of the third space 523 and the second space 522. The third space 523 may be coupled with the speaker hole 303. A sound passed through the third space 523 may be emitted to the outside of the electronic device 300 through the speaker hole 303.

According to an embodiment, the sheet 503 may be a part of the acoustic duct 520. The sheet 503 may be coupled to the side member 510 or the support portion 511. For example, the sheet 503 may be combined with the remaining members (the side member 510 or the support portion 511) of the acoustic duct 520. In order to prevent and/or reduce leakage of a sound emitted from the speaker 501, the sheet 503 may be sealed at a portion for coupling other members of the acoustic duct 520.

According to an embodiment, the sheet 503 may face a part of a face of the sound outlet 502 of the speaker 501. The sheet 503 may be disposed between the speaker 501 and the rear plate 480. According to an embodiment, the sheet 503 may be disposed in a narrow portion (e.g., the first space 521) located at a start portion of the acoustic duct 520. According to an embodiment, the sheet 503 may be substantially parallel to the rear plate 480. The sheet 503 may vibrate in response to a sound emitted from the speaker 501. If rigidity of the sheet 503 is low, an annoying noise may occur due to the vibration of the sheet 503. The sheet 503 may be have a thickness which enables vibration caused by a sound transferred through the acoustic duct. For example, the sheet 503 may include a thin film having a thickness in a range of, for example, 0.1 mm to 0.3 mm. The sheet 503 may be spaced apart by a specific distance range from the rear plate 480. The specific distance range may, for example, be 0.05 mm to 0.20 mm.

According to an embodiment, a vibration space 509 may be a space defined by the sheet 503 and rear plate 480 which are spaced apart by a specific distance from each other. The sheet 503 may vibrate in response to a sound emitted from the speaker 501 in the vibration space 509. An acoustic impedance generated in the narrow portion of the acoustic duct 520 may decrease when the sheet 503 vibrates in the vibration space 509 by the sound emitted from the speaker 501 and when the vibration caused by the sheet 503 is transferred to the vibration space 509 and the rear plate 480. With the decrease in the acoustic impedance, an acoustic tremor phenomenon of the sound emitted from the speaker 501 may be improved, and the electronic device 300 may provide improved audio to a user. According to an embodiment, various materials, thicknesses, or shapes of the sheet 503 may be determined by a manufacturing process or design. For example, a young's modulus of the sheet 503 may be in a range of, for example, approximately 1.2 Mpa to 196 Gpa. Rigidity of the sheet 503 may be lower than rigidity of the support portion 511. The sheet 503 may include, for example, and without limitation, at least one of Poly Carbonate (PC) and Stainless Steel (STS), or the like.

Figure 5A:
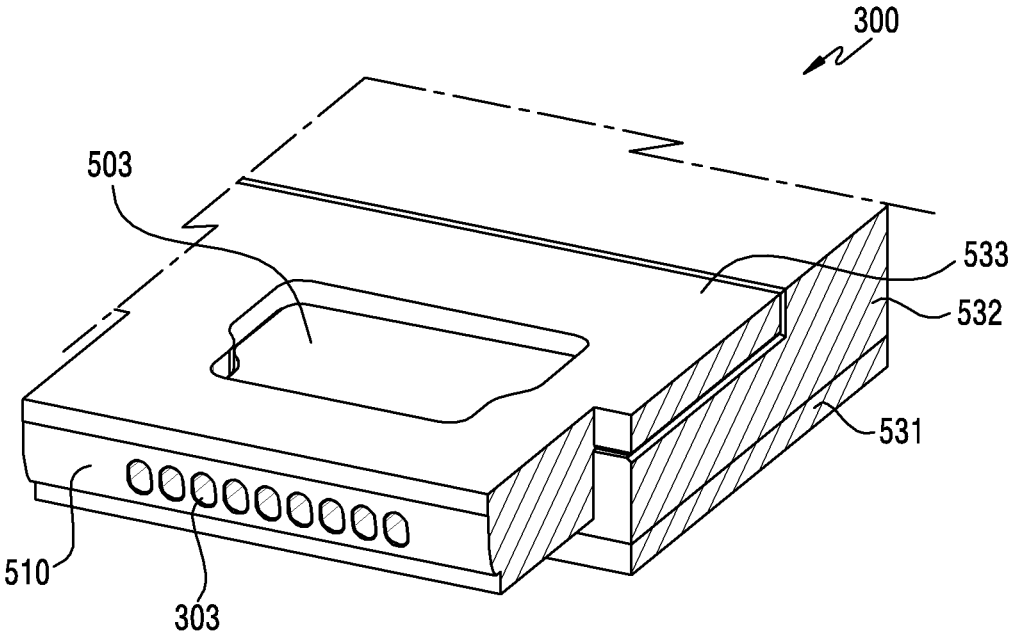
FIG. 5A is a perspective view illustrating an example electronic device according to an embodiment.
Figure 5B:
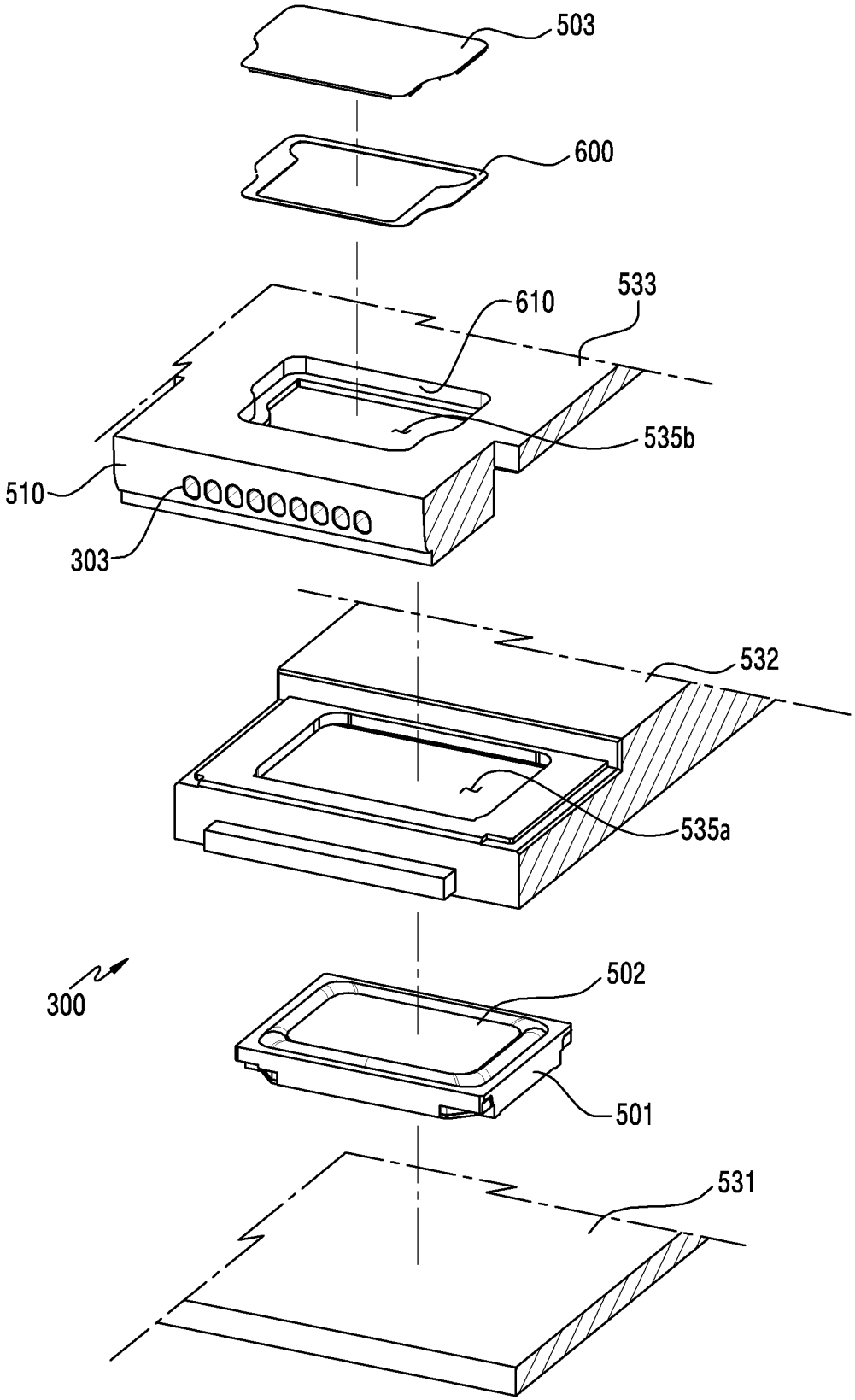
FIG. 5B is an exploded perspective view of the electronic device of FIG. 5A.

FIG. 5A is a perspective view of the electronic device 300 according to an embodiment. FIG. 5B is an exploded perspective view of the electronic device 300 of FIG. 5A.

A region in which the speaker 501 of the electronic device 300 is disposed is shown in FIG. 5A and FIG. 5B.

Referring to FIG. 5A and FIG. 5B, the electronic device 300 according to an embodiment may include the speaker 501, a first support portion 531, a second support portion 532, a third support portion 533, the sheet 503, and a sealing member 600.

According to an embodiment, the speaker 501 may be fixedly disposed on the first support portion 531. The speaker 501 may include a front face including the sound outlet 502 and a rear face facing the front face. The front face of the speaker 501 may be disposed to face the sheet 503. A part of the rear face of the speaker 501 may be in contact with the first support portion 531. The remaining parts of the rear face of the speaker 501 may be spaced apart from the first support portion 531 to provide a rear space. According to an embodiment, the first support portion 531 providing the rear space of the speaker 501 may be sealed to prevent and/or reduce leakage of a sound emitted to the rear space.

According to an embodiment, the speaker 501 may include a protection member (not shown) surrounding the sound outlet 502 at the front face.

According to an embodiment, the second support portion 532 may be combined with the third support portion 533 to provide an acoustic duct (e.g., the acoustic duct 520 of FIG. 4). A part of the second support portion 532 may be in contact with the speaker 501 and the third support portion 533. An empty space may be included inside the second support portion 532, and the speaker 501 may be disposed in the empty space. The second support portion 532 may include a first opening 535*a*. The first opening 535*a* may be provided along the sound outlet 502 of the speaker 501. A sound emitted from the sound outlet 502 of the speaker 501 may pass through the first opening 535*a*. A part of the second support portion 532 or a portion adjacent to the speaker 501 or third support portion 533 may be sealed to prevent and/or reduce leakage of the sound emitted from the speaker 501.

According to an embodiment, the third support portion 533 may include the speaker hole 303, a second opening 535*b*, and a mounting groove 610. The third support portion 533 may extend from the side member 510 to an inner space of the electronic device 300. The speaker hole 303 may be a part of the side member 510, and may be provided at a side face of the electronic device 300. The speaker hole 303 may be coupled with an acoustic duct (e.g., the acoustic duct 520 of FIG. 4) extending from the sound outlet of the speaker 501, and the sound emitted from the speaker 501 may be emitted to the outside through the speaker hole 303.

According to an embodiment, the second opening 535*b* may be disposed on the first opening 535*a*. The mounting groove 610 may be included inside the second opening 535*b*. The mounting groove 610 may be a space in which the sheet 503 or the sealing member 600 is disposed. The mounting groove 610 may be provided in association with a shape of the sheet 503 or sealing member 600. The mounting groove 610 may have a depth greater than a thickness of the sheet 503. A separation distance between the rear plate 480 and the sheet 503, disposed on the third support portion 533, may vary depending on the depth of the mounting groove 610. A space provided by the separation distance may be a space (e.g., the vibration space 509) in which the sheet 503 can vibrate.

According to an embodiment, the first support portion 531, the second support portion 532, or the third support portion 533 may extend from the side member 510. Some of the first support portion 531, the second support portion 532, and the third support portion 533 may be integral with a support member (e.g., the support portion 511 of FIG. 4). According to an embodiment, the sheet 503 may have a shape corresponding to a shape of the mounting groove 610. For example, the sheet 503 may include a portion of which a width decreases in a direction facing a speaker hole, such as a shape of the second opening 535*b* or mounting groove 610. The sheet 503 may be disposed directly to the third support portion 533, or may be disposed to the third support portion 533 in a state of being combined with the sealing member 600. The sheet 503 may be included as a part of the acoustic duct. A portion adjacent to the sheet 503 and third support portion 533 may be sealed by the sealing member 600.

According to an embodiment, the sheet 503 may face a part of a face of the sound outlet 502 of the speaker 501. The sheet 503 may be substantially parallel to the face of the sound outlet 502 of the speaker 501.

According to an embodiment, the sealing member 600 may be provided in accordance with a shape of the sheet 503 or mounting groove 610. The sealing member 600 may be a closed curve having a thickness, and the sealing member 600 may extend along an edge of the sheet 503. For example, the sealing member 600 may be disposed along the edge of the sheet 503, and may extend to the inside of the sheet 503. A second edge facing a first long edge portion of the sheet may be relatively thin, and the remaining third and fourth edges of the sheet may be relatively thick.

For another example, a shape of an outer edge of the sealing member 600 may correspond to a shape of the mounting groove 610, and a shape of an inner edge of the sealing member 600 may correspond to a shape of the sheet 503. According to an embodiment, the sealing member 600 may be located between the sheet 503 and the third support portion 533. The sealing member 600 may seal an adjacent portion between the third support portion 533 and the sheet 503 in order to prevent and/or reduce leakage of the sound emitted from the speaker 501. The sealing member 600 may be an adhesive member for combining the third support portion 533 and the sheet 503. For another example, the sheet 503 may be disposed between the third support portion 533 and the second support portion 532, and the sealing member 600 may be disposed on the sheet 503. The sealing member 600 and the sheet 503 may be disposed on the mounting groove 610.

In an embodiment, the support portion 511 and/or the side member 510 may include at least one of the first support portion 531, the second support portion 532, and/or the third support portion 533. Although the first support portion 531, the second support portion 532, and the third support portion 533 are illustrated as separate entities in FIG. 5B, at least two of the first support portion 531, the second support portion 532, and/or the third support portion 533 may be provided integrally.

Figure 6A:
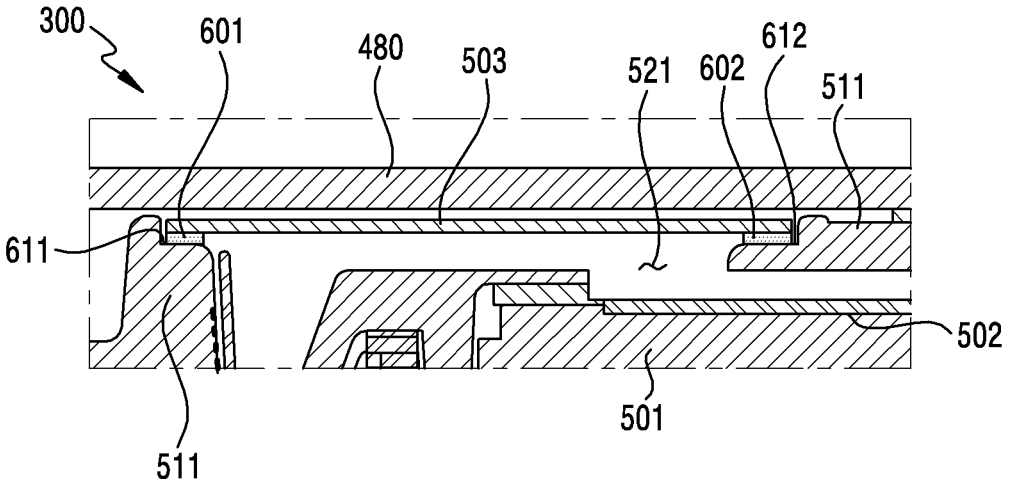
FIG. 6A is a cross-sectional view illustrating an example electronic device according to an embodiment.

FIG. 6A is a cross-sectional view illustrating the example electronic device 300 according to an embodiment.

Referring to FIG. 6A, the electronic device 300 may include the speaker 501, the sheet 503, and front sealing members 601 and 602 (e.g., the sealing member 600 of FIG. 5B).

According to an embodiment, the speaker 501 may be disposed to face the rear plate 480, and the sheet 503 may be disposed to overlap with a part of a face of the sound outlet 502 of the speaker 501.

According to an embodiment, the sheet 503 may include a front face facing the rear plate 480 and a rear face facing the speaker 501.

According to an embodiment, the support portion 511 may have a first mounting groove 611 and second mounting groove 612 for mounting the sheet 503. The first mounting groove 611 and the second mounting groove 612 may have a shape corresponding to a shape of a portion adjacent to the sheet 503. The first mounting groove 611 and the second mounting groove 612 may be adjacent to an edge of a rear face of the sheet 503. The first mounting groove 611 and the second mounting groove 612 may be adjacent to an edge of the front face of the sheet 503, and may be adjacent to the front face and rear face of the sheet 503. As shown in FIG. 5B, the first mounting groove 611 and the second mounting groove 612 may be formed integrally along an edge of the sheet 503.

According to an embodiment, a sound emitted from the sound outlet 502 of the speaker 501 may pass through the first space 521. The electronic device 300 may include the front sealing members 601 and 602 disposed between the edge of the sheet 503 and the support portion 511, in order to prevent and/or reduce sound leakage in the first space 521.

The sealing member 600 of FIG. 5B may include the first front sealing member 601 and/or the second front sealing member 602. For example, the electronic device 300 may include the first front sealing member 601 between the first mounting groove 611 and the sheet 503 and/or the second front sealing member 602 between the second mounting groove 612 and the sheet 503.

According to an embodiment, the front sealing members 601 and 602 may be disposed in a space in which the sheet 503 and the support portion 511 are adjacent to each other. The front sealing members 601 and 602 may seal the space in which the sheet 503 and the support portion 511 are adjacent to each other, in order to prevent and/or reduce leakage of a sound emitted from the speaker 501.

According to an embodiment, the first front sealing member 601 and the second front sealing member 602 may be provided integrally along the edge of the sheet 503. According to an embodiment, the front sealing members 601 and 602 may be adhesive members for coupling the sheet 503 and the support portion 511.

According to an embodiment, the sheet 503 may vibrate by a sound emitted from the speaker 501. The vibration of the sheet 503 may be transferred in a direction facing the rear plate 480 of the electronic device 300.

Figure 6B:
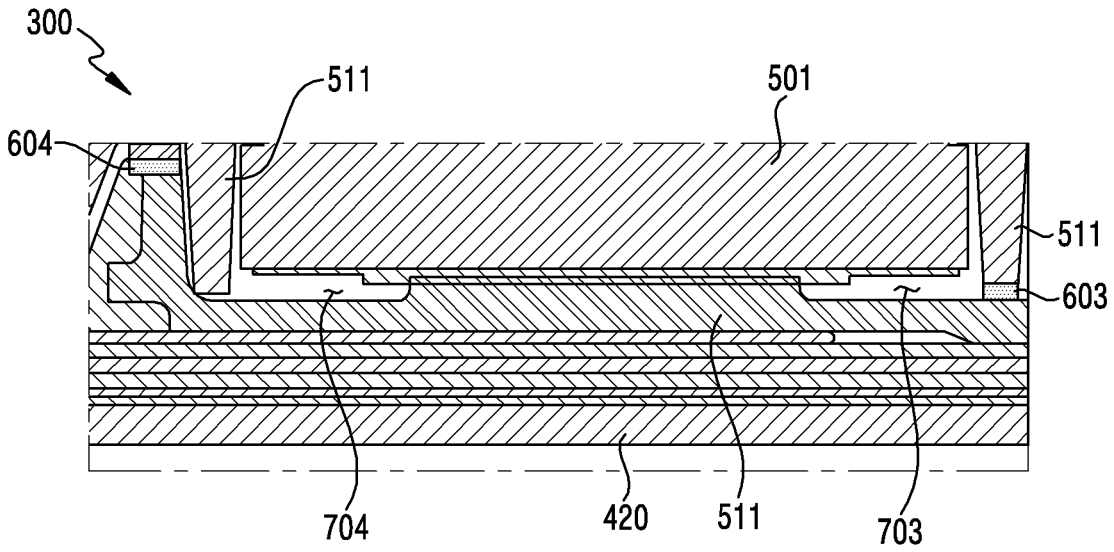
FIG. 6B is a cross-sectional view illustrating an example electronic device according to an embodiment.

FIG. 6B is a cross-sectional view illustrating an example electronic device 300 according to an embodiment.

Referring to FIG. 6B, the electronic device 300 may include the speaker 501, rear spaces 703 and 704 of the speaker 501, and rear sealing members 603 and 604.

According to an embodiment, the rear spaces 703 and 704 of the speaker 501 may be provided by the speaker 501 and the support portion 511. The rear spaces 703 and 704 of the speaker 501 may be provided between the front plate 420 and the speaker 501. A part of the speaker 501 may be in contact with the support portion 511, and the remaining parts of the speaker 501 may be spaced apart from the support portion 511 to provide the rear spaces 703 and 704. The rear spaces 703 and 704 of the speaker 501 may be provided as one space according to a portion in which the speaker 501 and the support portion 511 are in contact with each other.

According to an embodiment, a sound generated in the speaker 501 may be emitted to the rear spaces 703 and 704 of the speaker 501. The rear spaces 703 and 704 of the speaker 501 may be acoustic resonance spaces. The rear sealing members 603 and 604 may be disposed on the support portion 511. The rear sealing members 603 and 604 may seal the rear spaces 703 and 704 of the speaker, in order to prevent and/or reduce leakage of the sound emitted to the back face of the speaker 501.

Figure 7:
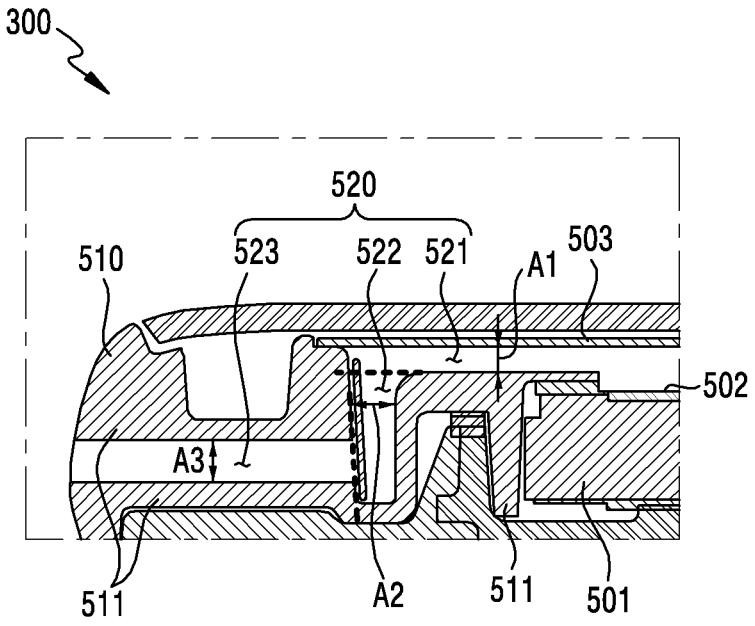
FIG. 7 is a cross-sectional view illustrating an example electronic device according to an embodiment.

FIG. 7 is a cross-sectional view illustrating an example electronic device 300 according to an embodiment.

Referring to FIG. 7, the electronic device 300 may include the first space 521, second space 522, and third space 523 defining the acoustic duct 520.

According to an embodiment, the first space 521 may be defined by the sheet 503 and the support portion 511. A sound emitted from the sound outlet 502 of the speaker 501 may pass through the first space 521. A1 may indicate an area of a cross-section cut along the first space 521 in a direction vertical to a direction in which the sound passing through the first space 521 travels.

The second space 522 may be provided in the support portion 511, and may extend in a direction away from the sheet 503. The sound passed through the first space 521 may pass through the second space 522. A2 may indicate an area of a cross-section cut along the second space 522 in a direction vertical to a direction in which the sound passing through the second space 522 travels.

The third space 523 may be provided in the support portion 511 or the side member 510, and may extend toward a side face (e.g., the side face 310C of FIG. 3A) of the electronic device 300. The sound passed through the second space 522 may pass through the third space 523. A3 may indicate an area of a cross-section cut along the third space 523 in a direction vertical to a direction in which the sound passing through the third space 523 travels. A1 may be smaller than A2 and/or A3.

According to an embodiment, among the first space 521, second space 522, and third space 523 of the acoustic duct 520, the area A1 of the cross-section of the first space 521 may be smallest. The first space 521 may be a relatively narrow portion of the acoustic duct 520, and may be a region in which an impedance of a sound emitted from the sound outlet 502 of the speaker 501 is highest. The vibratable sheet 503 may be disposed to decrease an acoustic impedance of the first space.

Figure 8:
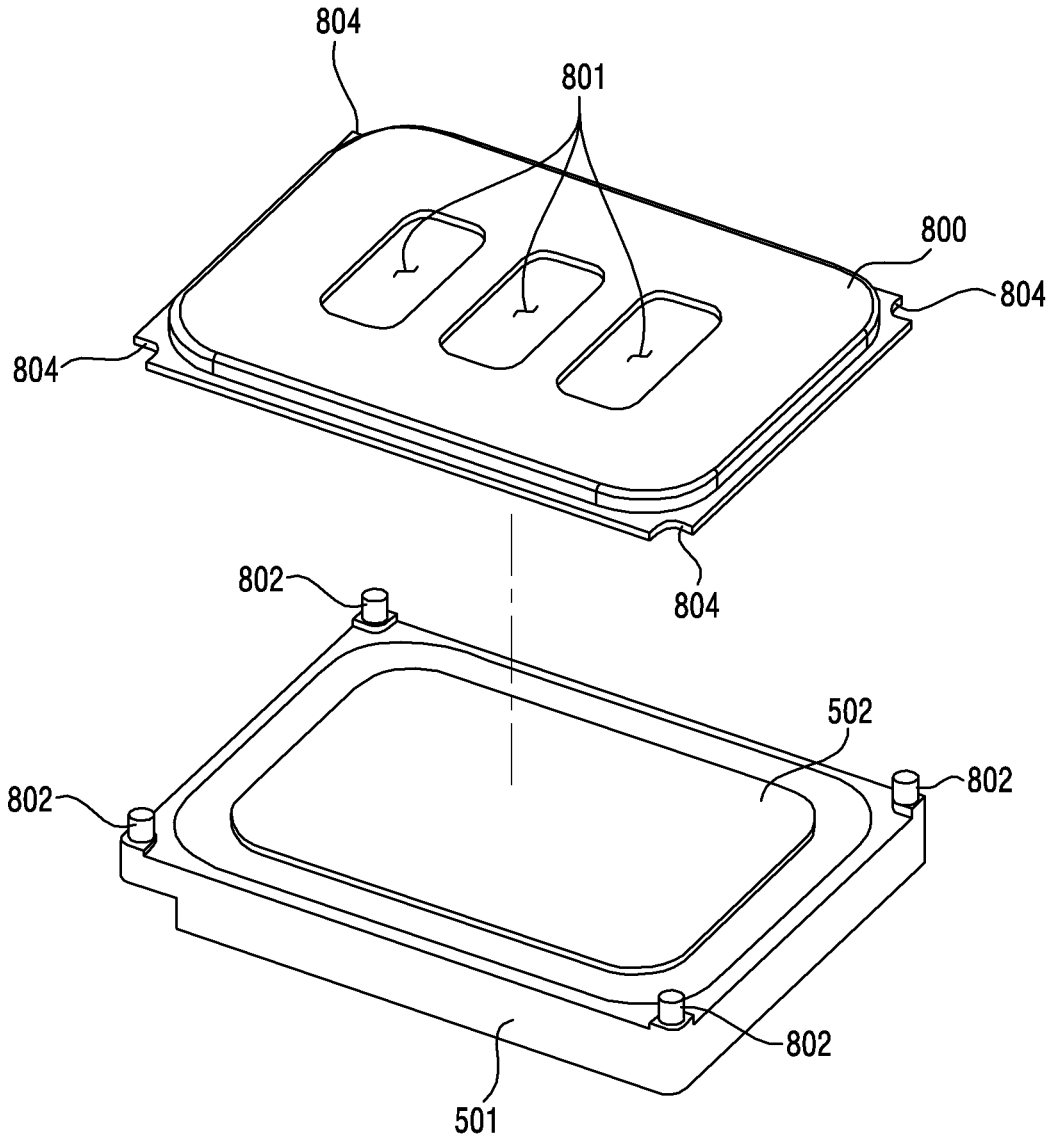
FIG. 8 is an exploded perspective view of an example speaker according to an embodiment.

FIG. 8 is an exploded perspective view illustrating an example speaker 501 according to an embodiment.

Referring to FIG. 8, the speaker 501 may include a protection member 800.

According to an embodiment, the protection member 800 may protect the speaker 501 from an external impact. The protection member 800 may be disposed above the sound outlet 502 of the speaker 501. The protection member 800 may be combined with the speaker 501 by, for example, at least one protrusion 802. The protection member 800 may include at least one opening 801. A sound emitted from the sound outlet 502 may pass through the opening 801.

The speaker 501 may include the protrusion 802 that can be combined with the protection member 800. The protection member 800 may include at least one groove 804 at a position corresponding to the protrusion 802. The groove 804 of the protection member 800 may be engaged with the protrusion 802 provided at the speaker, and the protection member 800 may be fixed to the speaker.

Figure 9:
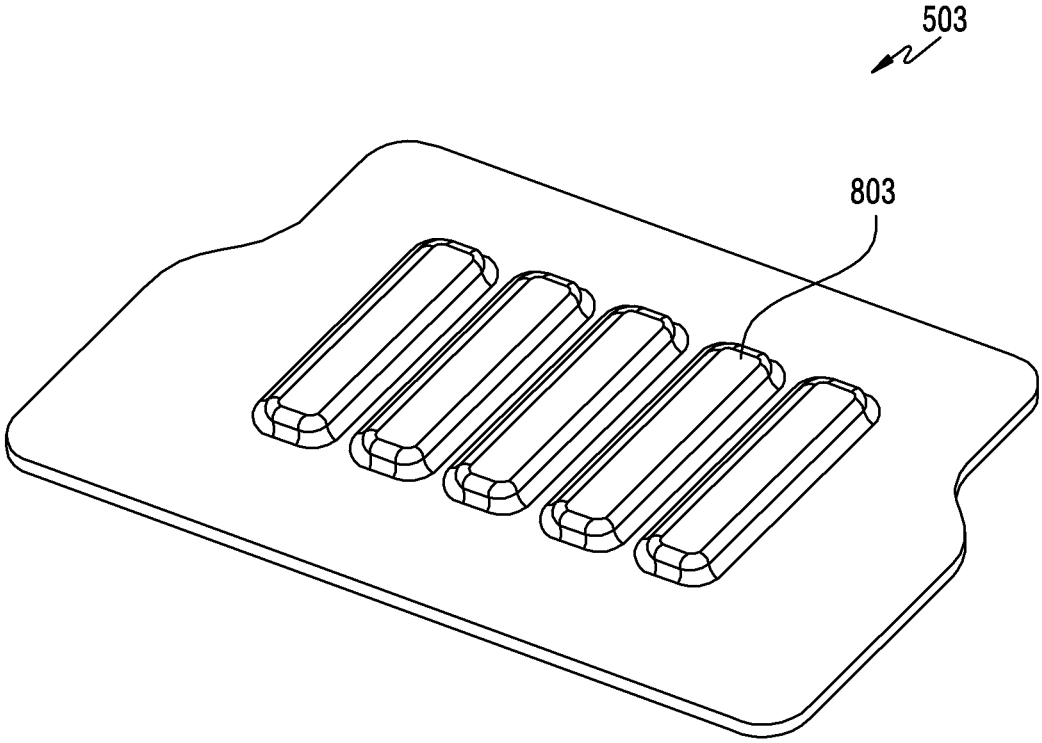
FIG. 9 is a perspective view illustrating an example sheet according to an embodiment.

FIG. 9 is a perspective view illustrating an example sheet 503 according to an embodiment.

Referring to FIG. 9, the sheet 503 may have at least one concavo-convex portion 803 that may be repeated on one face. The number of concavo-convex portions 803 may be at least one. Rigidity of the sheet 503 may be changed by changing a shape of the sheet 503. An increase in the rigidity of the sheet may lead to an increase in a sound volume in a speaker hole (e.g., the speaker hole 303 of FIG. 4) or a third space (e.g., the third space 523 of FIG. 4). The sheet may have various shapes to increase the rigidity of the sheet without a change in a material of the sheet. For example, a repetitive embossing may be provided on a surface of the sheet 503. Since a vibration of the sheet 503 may deteriorate when the rigidity increases, the sheet 503 may be adjusted to have proper rigidity when manufactured.

Figure 10A:
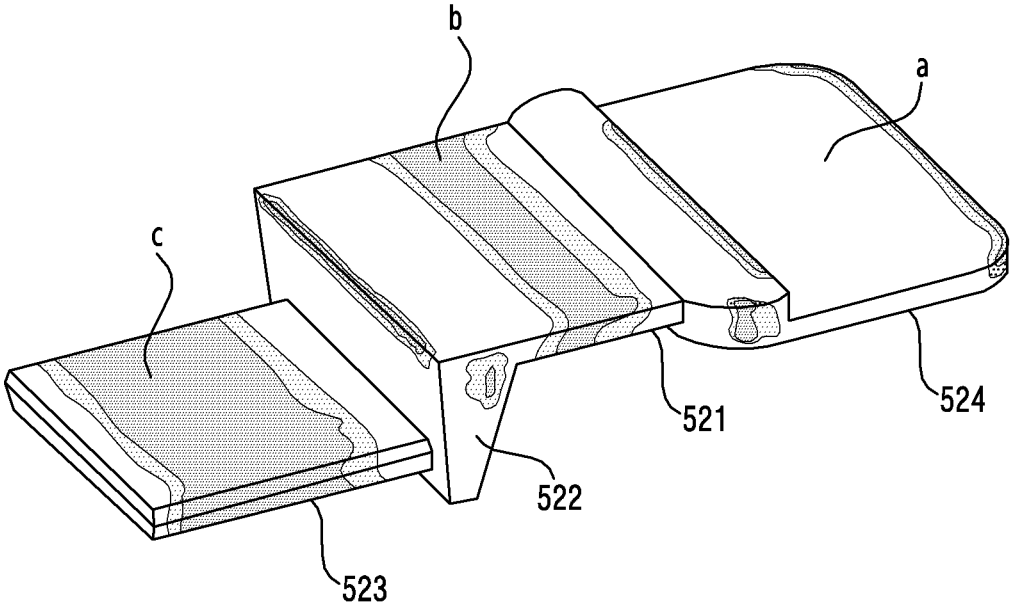
FIG. 10A is a diagram graphically illustrating a state in which the sheet is not disposed to an acoustic duct.
Figure 10B:
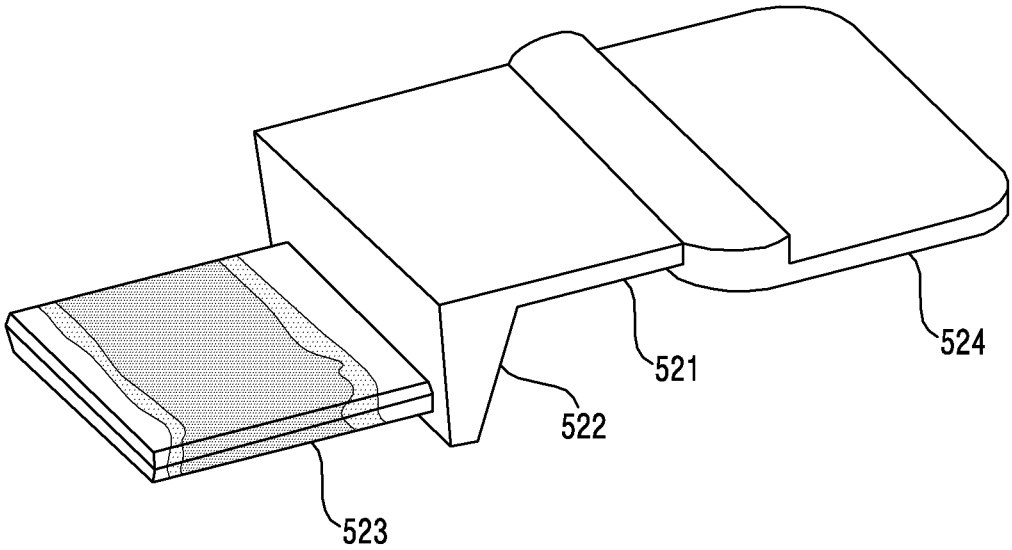
FIG. 10B is a diagram graphically illustrating a state in which the vibratable sheet is disposed to the acoustic duct according to an embodiment.

FIG. 10A and FIG. 10B are diagrams graphically illustrating an acoustic impedance of an acoustic duct not having a sheet inside each electronic device and an acoustic impedance of the acoustic duct 520 having the sheet 503, respectively, inside the electronic device 300 according to an embodiment.

Referring to FIG. 10A, a sound pressure level (or an acoustic impedance) is shown when a sound generated in the speaker 501 passes through the fourth space 524, the first space 521, the second space 522, and the third space 523. When the sound pressure level of the sound generated in the speaker 501 is low, it may be expressed in bright color indicated by 'a', and when the sound pressure level of the sound generated in the speaker 501 is high, it may be expressed in dark color indicated by 'b' or 'c'.

FIG. 10A illustrates a graph in a state in which the sheet 503 is not disposed to an acoustic duct. Referring to FIG. 10A, an electronic device having an acoustic duct not having a vibratable sheet may have a highest acoustic impedance when the sound emitted from the speaker passes through the first space 521. The acoustic impedance may increase while the sound emitted from the speaker passes through the narrow first space 521. A deterioration of an acoustic characteristic such as an acoustic tremor or the like may be expected due to the increase in the acoustic impedance.

FIG. 10B illustrates a graph in a state in which the vibratable sheet 503 is disposed to the acoustic duct 520. Referring to FIG. 10B, the electronic device 300 including the acoustic duct 520 having the vibratable sheet 503 may decrease an acoustic impedance due to a vibration of the sheet 503 when a sound emitted from the speaker 501 passes through the narrow first space 521.

In the first space 521 of the acoustic duct 520, the electronic device 300 of FIG. 10B may have a lower acoustic impedance than the electronic device of FIG. 10A. The electronic device 300 may maintain emission sound pressure in the third space 523, compared with the electronic device of FIG. 10A.

Figure 11:
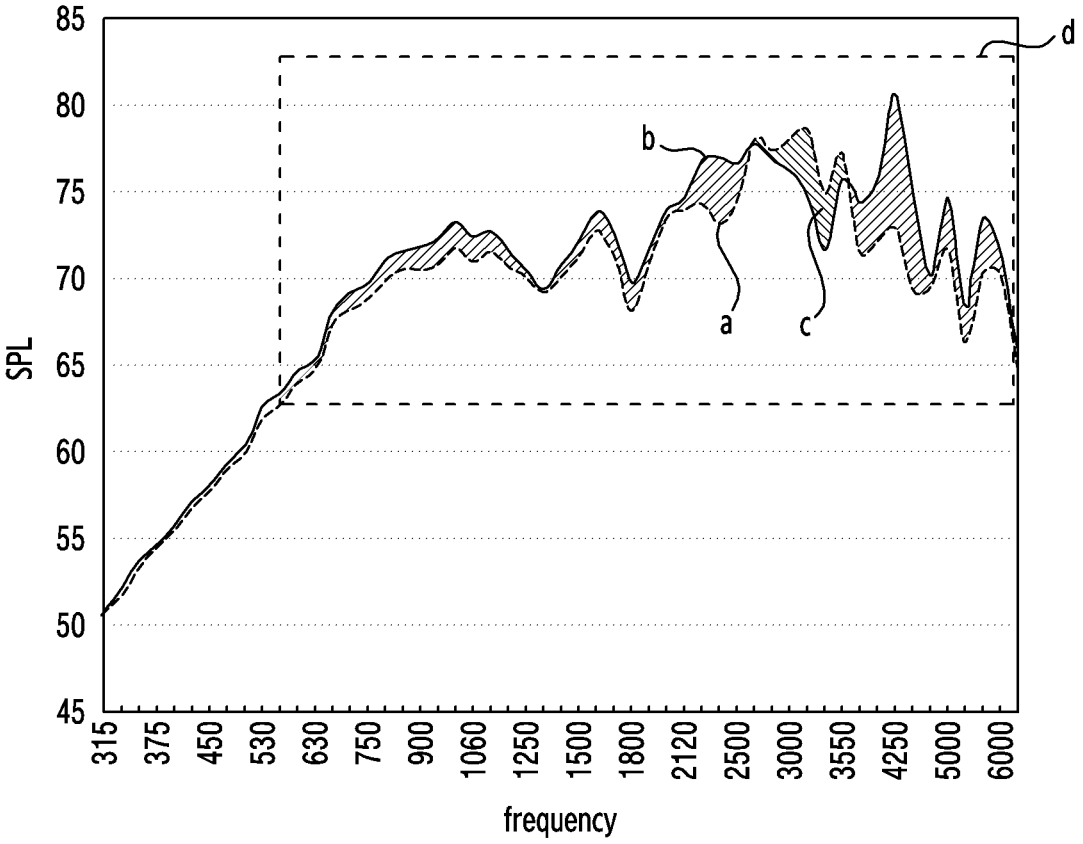
FIG. 11 is a graph illustrating improvement of an acoustic characteristic depending on the sheet according to an embodiment.

FIG. 11 is a graph illustrating example improvement of an acoustic characteristic depending on the sheet 503.

FIG. 11 illustrates a sound pressure level based on a frequency band of a sound emitted from the speaker 501.

Referring to FIG. 11, 'a' is a graph in a state in which the sheet 503 is not disposed to an acoustic duct. 'b' is a graph in a state in which the sheet 503 is disposed to the acoustic duct 520.

In a case (see 'b) where the sheet 503 is disposed to the acoustic duct 520, compared to a case (see 'a') where the sheet 503 is not disposed to the acoustic sheet, a sound pressure level may decrease in a region c, and the sound pressure level may increase in regions other than the region c. For example, in a range d, sound pressure of a ridge provided to be high may decrease, and sound pressure of a valley provided to be low may increase. Since the sheet 503 vibrates by the sound emitted from the speaker 501, a sound pressure level based on a frequency band may be equalized.

An electronic device (e.g., the electronic device 300 of FIG. 4) according to various example embodiments may include a housing including a plate (e.g., the rear plate 480 of FIG. 4) providing a first face of the electronic device and a side portion (e.g., the side member 510 of FIG. 4) extending along an edge of the plate to provide a side face of the electronic device, a speaker (e.g., the speaker 501 of FIG. 4) including a sound outlet (e.g., the sound outlet 502 of FIG. 4) disposed in a support of the housing (e.g., the support portion 511 of FIG. 4) extending from the side portion to an inner space and is configured to emit a sound in a direction facing the first face, a sheet (e.g., the sheet 503 of FIG. 4) disposed between the plate and the speaker, and an acoustic duct (e.g., the acoustic duct 520 of FIG. 4) defined at least in part by the sheet and the support spaced apart from the plate, and extending from the sound outlet of the speaker to a part of the side face.

According to an example embodiment, the sheet may be configured to vibrate in response to a sound emitted from the speaker.

According to an example embodiment, the sheet may have a concavo-convex portion provided at one face.

According to an example embodiment, the sheet may include at least one of poly carbonate and stainless steel.

According to an example embodiment, the sheet may be disposed to be parallel with the first face, and at least part of the sheet may face the speaker.

According to an example embodiment, the speaker may include a protection member (e.g., the protection member 800 of FIG. 8) disposed on a face where the sound outlet is located.

According to an example embodiment, the protection member may be disposed to cover the face where the sound outlet is disposed. The protection member may include at least one opening (e.g., at least one opening 801 of FIG. 8).

According to an example embodiment, the sheet may be spaced apart from the plate by a distance in a range of 0.05 to 0.20 mm.

According to an example embodiment, the electronic device may further include a first seal (e.g., the sealing member 600 of FIG. 5B) configured to seal a space (e.g., the first space 521 of FIG. 4) where the support and the sheet are adjacent to each other.

According to an example embodiment, the electronic device may further include a second seal (e.g., the rear sealing members 603 and 604 of FIG. 6B) configured to seal a sound emitted toward a rear face of the sound outlet.

According to an example embodiment, the electronic device may further include a display (e.g., the display 430 of FIG. 4) defining a second face of the electronic device, facing the first face, and including a plurality of layers.

According to an example embodiment, the acoustic duct may include a first space (e.g., the first space 521 of FIG. 4) extending from the sound outlet of the speaker along the sheet, a second space (e.g., the second space 522 of FIG. 4) extending from the first space in a direction away from the plate, and a third space (e.g., the third space 523 of FIG. 4) facing the side face and extending from the second space.

According to an example embodiment, the sheet may be included in a part of the first space.

According to an example embodiment, in the acoustic duct, a cross-section of the first space may be narrower than a cross-section of the second space or a cross-section of the third space. The cross-section may be vertical to a direction in which a sound of the acoustic duct travels.

According to an example embodiment, the side portion may be provided integrally with the plate.

An electronic device (e.g., the electronic device 300 of FIG. 4) according to various example embodiments may include a plate (e.g., the rear plate 480 of FIG. 4) defining a first face of the electronic device, a display (e.g., the display 430 of FIG. 4) defining a second face of the electronic device, facing the first face, and including a plurality of layers, a side portion of a housing (e.g., the side member 510 of FIG. 4) extending along an edge of the plate to provide a side face of the electronic device, a speaker (e.g., the speaker 501 of FIG. 4) including a sound outlet (e.g., the sound outlet 502 of FIG. 4) disposed on a support portion (e.g., the support portion 511 of FIG. 4) of the housing extending from the side portion of the housing to an inner space and configured to emit a sound in a direction facing the first face, a sheet (e.g., the sheet 503 of FIG. 4) disposed between the plate and the speaker, a first space (e.g., the first space 521 of FIG. 4) provided along the sheet and the support portion and being spaced apart from the plate, the first space configured to pass a sound emitted from the sound outlet, a second space (e.g., the second space 522 of FIG. 4) provided by the support portion, coupled to the first space, and extending from the first space in a direction away from the plate, and a third space (e.g., the third space 523 of FIG. 4) provided by the support portion, coupled to the second place, and extending from the second space in a direction facing the side face.

According to an example embodiment, a cross-section of the second space may be wider than a cross-section of the first space, and a sound passed through the first space may pass through the second space. The cross-section of the first space may be vertical to a direction in which a sound passing through the first space travels. The cross-section of the second space may be vertical to a direction in which a sound passing through the second space travels.

According to an example embodiment, a cross-section of the third space may be wider than the cross-section of the first space, and a sound passed through the second space may pass through the third space. The cross-section of the third space may be vertical to a direction in which a sound passing through the third space travels.

According to an example embodiment, the sheet may include a material having a lower rigidity than a rigidity of the support portion.

According to an example embodiment, the sheet may include at least one of poly carbonate and stainless steel.

According to an example embodiment, the sheet may be parallel with the first face, and at least part of the sheet may face the speaker.

While the disclosure has been illustrated and described with reference to various example embodiments thereof, it will be understood by those skilled in the art that various changes in form and details may be made therein without departing from the scope of the disclosure. Therefore, the scope of the disclosure should not be defined as being limited to the embodiments, and should include the appended claims and equivalents thereof.

What is claimed is:

1. An electronic device comprising:

a housing including a rear plate defining a first face of the electronic device and a side portion extending along an edge of the rear plate and defining a side face of the electronic device;

a speaker including a sound outlet disposed on a support portion of the housing extending from the side portion to an inner space of the electronic device, the sound outlet disposed in a direction facing the first face;

a sheet disposed between the rear plate and the sound outlet of the speaker and displaced from the rear plate, at least a portion of the sheet disposed across from at least a portion of the sound outlet of the speaker; and an acoustic duct defined at least in part by the sheet and the support portion, the acoustic duct being spaced apart from the rear plate and extending from the sound outlet of the speaker to the side face, wherein the sheet is configured to vibrate in response to a sound emitted from the speaker, and wherein the sheet is spaced apart from the rear plate by a distance in a range of from 0.05 to 0.20 mm.

2. The electronic device of claim 1, wherein the sheet includes a concavo-convex portion on one face.

3. The electronic device of claim 1, wherein the sheet includes at least one of poly carbonate or stainless steel.

4. The electronic device of claim 1, wherein the sheet is disposed to be parallel with the first face.

5. The electronic device of claim 1, wherein the speaker includes a protection member disposed on a face where the sound outlet is disposed.

6. The electronic device of claim 1, further comprising a first seal configured to seal a space in which the support portion and the sheet are adjacent to each other.

7. The electronic device of claim 6, further comprising a second seal configured to seal a sound emitted toward a rear face of the sound outlet.

8. The electronic device of claim 1, further comprising a display defining a second face of the electronic device, facing the first face, and including a plurality of layers.

9. The electronic device of claim 1, wherein the acoustic duct includes a first space extending from the sound outlet of the speaker along the sheet, a second space extending from the first space in a direction away from the rear plate, and a third space extending from the second space toward the side face.

10. The electronic device of claim 9, wherein the sheet is a part of the first space.

11. The electronic device of claim 9, wherein, in the acoustic duct, a cross-section of the first space is less than a cross-section of the second space or a cross-section of the third space, and wherein the cross-section of each of the first space, the second space and the third space is vertical to a direction in which a sound travels in the acoustic duct.

12. The electronic device of claim 1, wherein the side portion is integral with the rear plate.

13. An electronic device comprising:

a rear plate defining a first face of the electronic device;

a display defining a second face of the electronic device, facing the first face, and including a plurality of layers;

a side portion of a housing extending along an edge of the rear plate and defining a side face of the electronic device;

a speaker including a sound outlet disposed on a support portion of the housing extending from the side portion to an inner space and configured to emit a sound in a direction facing the first face;

a sheet disposed between the rear plate and the sound outlet of the speaker and displaced from the rear plate, at least a portion of the sheet disposed across from at least a portion of the sound outlet of the speaker;

a first space provided along the sheet and the support portion and spaced apart from the rear plate, the first space configured to pass a sound emitted from the sound outlet;

a second space provided by the support portion, coupled to the first space, and extending from the first space in a direction away from the rear plate; and a third space provided by the support portion, coupled to the second place, and extending from the second space in a direction facing the side face, wherein the sheet is configured to vibrate in response to a sound emitted from the speaker, and wherein the sheet is spaced apart from the rear plate by a distance in a range of from 0.05 to 0.20 mm.

14. The electronic device of claim 13, wherein a cross-section of the second space is greater than a cross-section of the first space, wherein the first space and the second space are configured so that a sound passed through the first space passes through the second space, wherein the cross-section of the first space is vertical to a direction in which a sound passing through the first space travels, and wherein the cross-section of the second space is vertical to a direction in which a sound passing through the second space travels.

15. The electronic device of claim 14, wherein a cross-section of the third space is greater than the cross-section of the first space, wherein the second space and the third space are configured so that a sound passed through the second space passes through the third space, and wherein the cross-section of the third space is vertical to a direction in which a sound passing through the third space travels.

16. The electronic device of claim 13, wherein the sheet includes a material having a rigidity less than a rigidity of the support portion.

17. The electronic device of claim 13, wherein the sheet includes at least one of poly carbonate or stainless steel.

18. The electronic device of claim 13, wherein the sheet is disposed to be parallel with the first face.

* * * * *